US008982031B2

(12) United States Patent
Hung et al.

(10) Patent No.: US 8,982,031 B2
(45) Date of Patent: Mar. 17, 2015

(54) DISPLAY PANEL HAVING A PLURALITY OF MULTIPLEXERS FOR DRIVING A PLURALITY OF FIRST DRIVING SWITCHES AND A PLURALITY OF SECOND DRIVING SWITCHES

(75) Inventors: Yi-Xuan Hung, Hsin-Chu (TW); Yu-Hsin Ting, Hsin-Chu (TW); Chen-Ming Chen, Hsin-Chu (TW); Szu-Chieh Chen, Hsin-Chu (TW); Da-Wei Fan, Hsin-Chu (TW); Chung-Lin Fu, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 142 days.

(21) Appl. No.: 13/610,900

(22) Filed: Sep. 12, 2012

(65) Prior Publication Data

US 2013/0127801 A1 May 23, 2013

(30) Foreign Application Priority Data

Nov. 18, 2011 (TW) ..... 100142448 A

(51) Int. Cl.
*G09G 3/36* (2006.01)
*G09G 3/20* (2006.01)

(52) U.S. Cl.
CPC ..... *G09G 3/20* (2013.01); *G09G 2310/0218* (2013.01); *G09G 2310/0275* (2013.01); *G09G 2310/0281* (2013.01); *G09G 2310/0297* (2013.01)
USPC ..... 345/98; 345/99

(58) Field of Classification Search
CPC ..... G09G 3/3611; G09G 3/3644
USPC ..... 345/98–99, 204
See application file for complete search history.

(56) References Cited

U.S. PATENT DOCUMENTS

2001/0052888 A1* 12/2001 Hebiguchi ..... 345/87
2002/0041278 A1* 4/2002 Matsueda ..... 345/204
2004/0233184 A1 11/2004 Toriumi
2009/0289878 A1* 11/2009 Chen ..... 345/87
2010/0302266 A1* 12/2010 Morita ..... 345/559
2011/0279490 A1* 11/2011 Lee et al. ..... 345/691
2011/0316831 A1* 12/2011 Ochiai et al. ..... 345/208

FOREIGN PATENT DOCUMENTS

CN 1530908 A 9/2004

* cited by examiner

*Primary Examiner* — Long D Pham
(74) *Attorney, Agent, or Firm* — Winston Hsu; Scott Margo

(57) ABSTRACT

A display panel includes a plurality of first driving switches installed at a first side of the display panel, a plurality of second switches installed at a second side of the display panel, a plurality of first data lines, a plurality of second data lines, a plurality of scan lines, and a plurality of pixels. Each of the first driving switches includes a first input end and a plurality of first output ends. Each of the second driving switches includes a second input end and a plurality of second output ends. The first data lines are electrically connected to the first output ends. The second data lines are electrically connected to the second output ends. The plurality of pixels are electrically connected to the plurality of first data lines, second data lines and scan lines for displaying images. The first data lines and the second data lines are arranged interlacedly.

12 Claims, 10 Drawing Sheets

DISPLAY PANEL HAVING A PLURALITY OF MULTIPLEXERS FOR DRIVING A PLURALITY OF FIRST DRIVING SWITCHES AND A PLURALITY OF SECOND DRIVING SWITCHES

BACKGROUND OF THE INVENTION

1. Field of the Invention

The present invention relates to a display panel, and more particularly, to a source driving structure of a display panel.

2. Description of the Prior Art

Please refer to FIG. 1. FIG. 1 is a diagram showing a display panel 100 of the prior art. The display panel 100 is divided into a plurality of display blocks 110 and 120. The display blocks 110 and 120 are respectively controlled by the multiplexers 130 and 140. The multiplexers 130 and 140 are electrically connected to a driving circuit 150 for receiving source driving signals of the driving circuit 150. Driving switches 132, 142 of the multiplexers 130, 140 then transmit the source driving signals to pixels P turned on by the scan lines SL via the data lines DL, such that the pixels display images according to the source driving signals. As shown in FIG. 1, the multiplexer 140 is arranged at an upper side of the display panel 100 for transmitting source driving signals to pixels P at the right side of the display panel 100 via the data lines DL, and the multiplexer 130 is arranged at a lower side of the display panel 100 for transmitting source driving signals to pixels P at the left side of the display panel 100 via the data lines DL.

However, according to the above arrangement, the driving switches 132 of the multiplexer 130 are adjacent to each other as well as the driving switches 142 of the multiplexer 140, such that horizontal spaces between the driving switches 132, 142 are limited, thus the driving switches 132, 142 of the multiplexer 130, 140 occupy more vertical space. Therefore, required widths of upper edge and lower edge of the display panel 100 need to be larger for the multiplexers 130, 140. On the other hand, other spaces of the upper edge and lower edge without arranging the multiplexers 130, 140 are wasted. In addition, a signal line L2 electrically connected to the multiplexer 130 is longer than a signal line L1 electrically connected to the multiplexer 140, such that loading of the pixels P at the right side is different from loading of the pixels P at the left side. Therefore, images displayed by the left side of the display panel 100 are not consistent with images displayed by the right side of the display panel 100.

Moreover, the transistor made of indium gallium zinc oxide (IGZO) has an advantage for allowing electrons moving faster, such that the transistor has better current driving capability. Therefore, the transistor made of IGZO has advantages of fewer mask processes, lower cost than LTPS process, and better surface flatness on a TFT substrate. However, an electron moving speed of IGZO is slower than an electron moving speed of Low Temperature Poly-silicon (LTPS), such that when applying IGZO to design of the multiplexers, the multiplexers occupy more space; and when applying IGZO to a high resolution display device, there are more concerns for arrangement of space.

SUMMARY OF THE INVENTION

The present invention provides a display panel comprising a first multiplexer, a second multiplexer, a plurality of first data lines, a plurality of second data lines, a plurality of scan lines, and a plurality of pixels. The first multiplexer is arranged at a first side of the display panel, and the first multiplexer comprises a plurality of first driving switches. Each first driving switch comprises a first input end for receiving a first source driving signal, and a plurality of first output ends for outputting the first source driving signal. The second multiplexer is arranged at a second side of the display panel, and the second multiplexer comprises a plurality of second driving switches. Each second driving switch comprises a second input end for receiving a second source driving signal, and a plurality of second output ends for outputting the second source driving signal. The plurality of first data lines are electrically connected to the plurality of first output ends for transmitting the first source driving signal. The plurality of second data lines are electrically connected to the plurality of second output ends for transmitting the second source driving signal. The plurality of pixels are electrically connected to the plurality of first data lines, the plurality of second data lines and the plurality of scan lines for displaying images according to the first source driving signal and the second source driving signal. The plurality of first data lines and the plurality of second data lines are interlacedly arranged.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
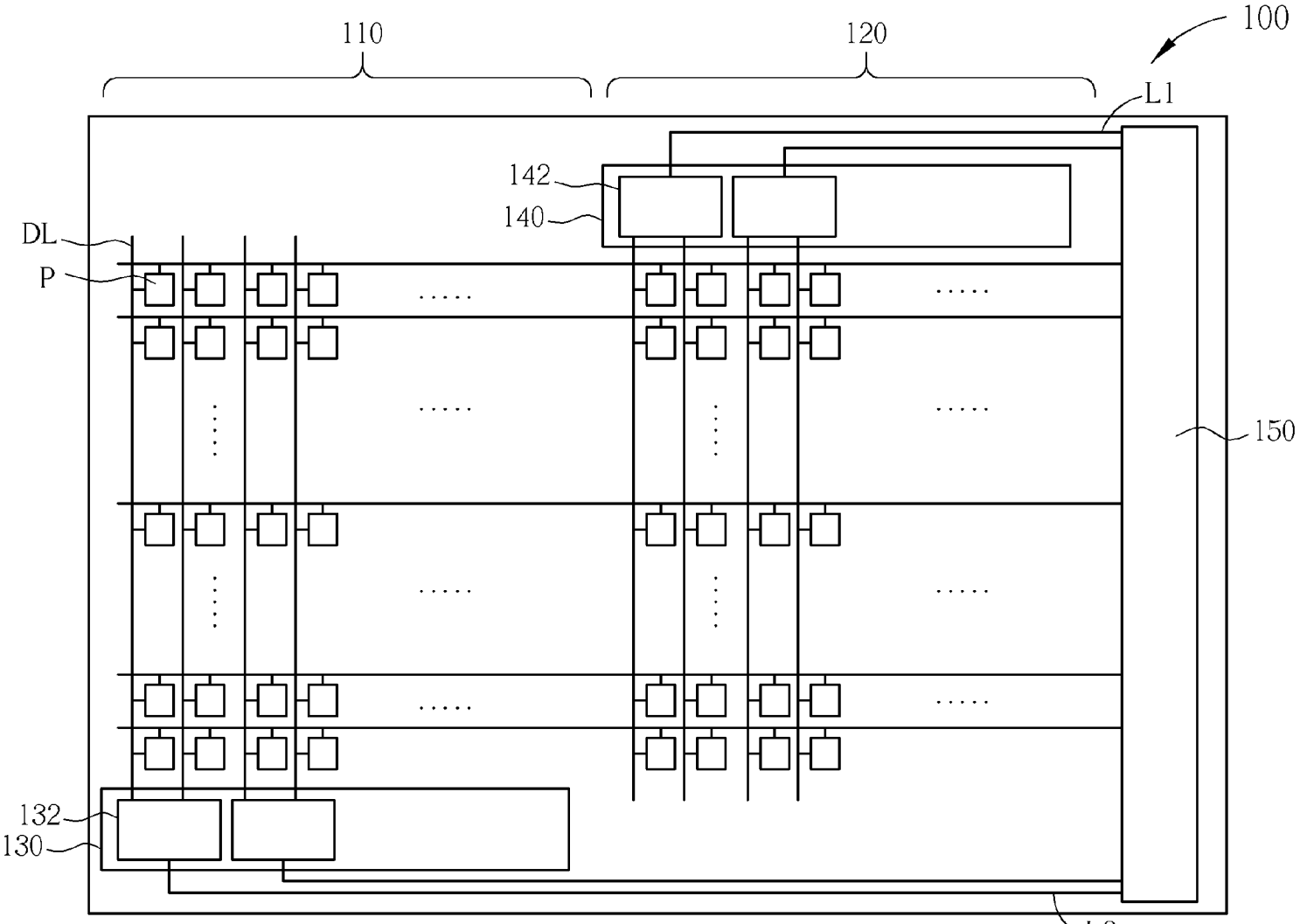
FIG. 1 PRIOR ART
FIG. 1 is a diagram showing a display panel 100 of the prior art.
Figure 2:
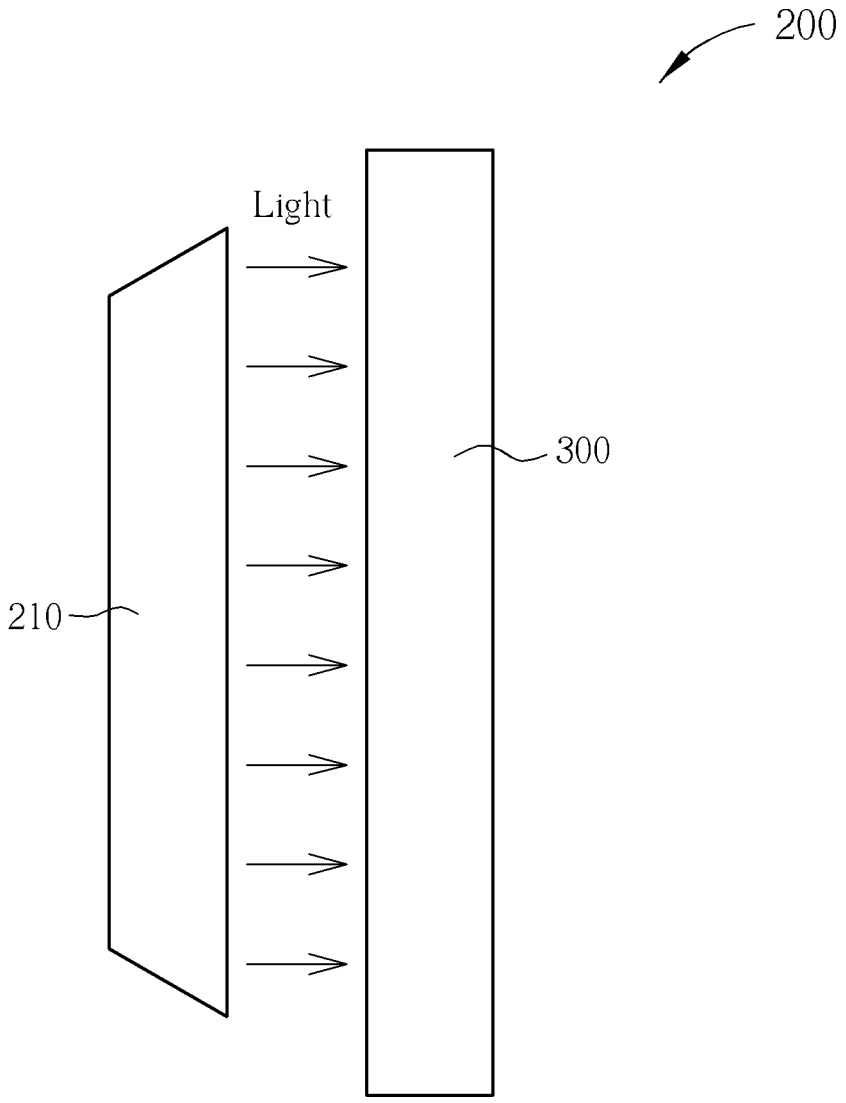
FIG. 2 is a diagram showing a display device of the present invention.
Figure 3:
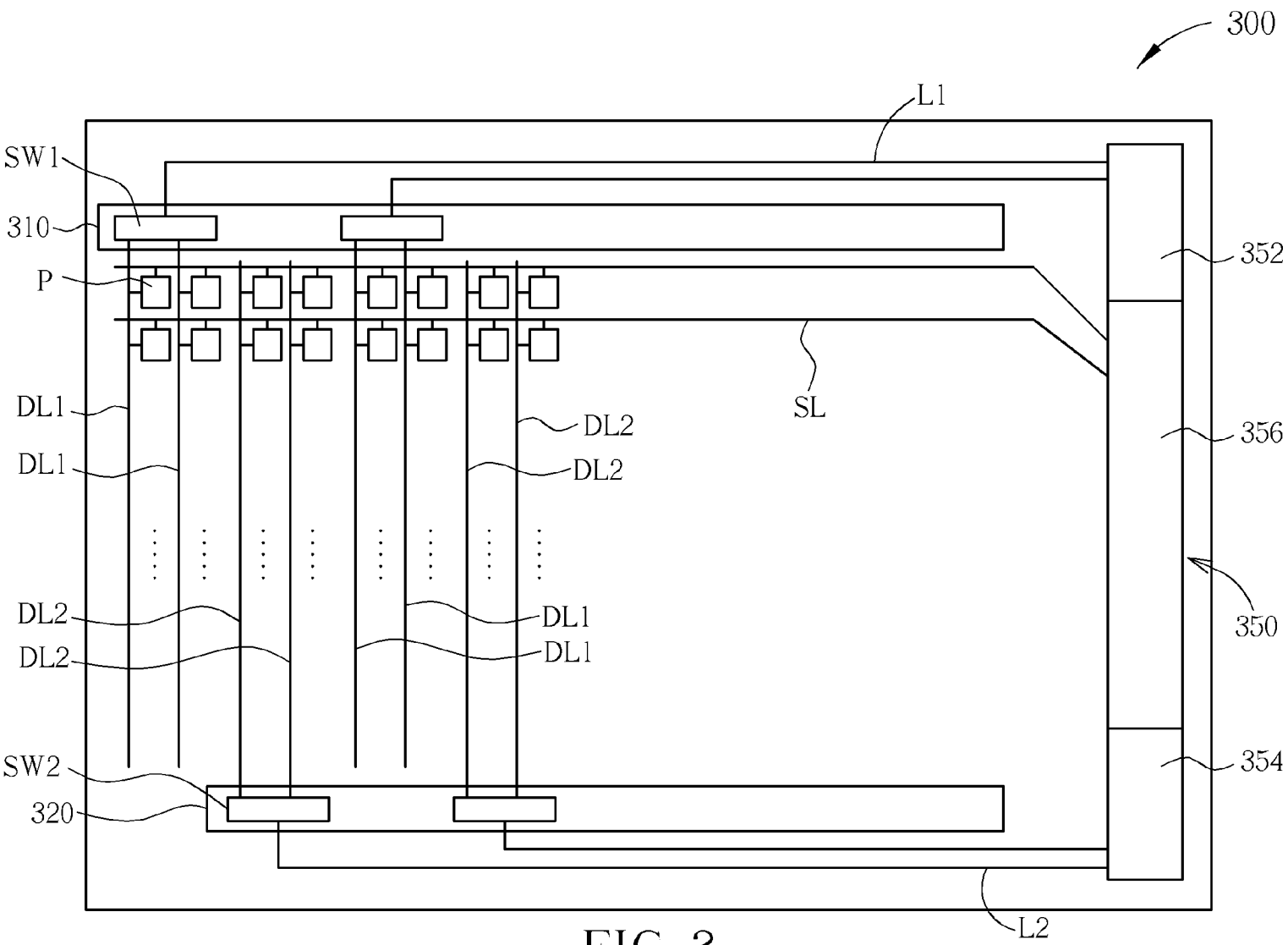
FIG. 3 is a diagram showing a first embodiment of a display panel of the display device of FIG. 2.
Figure 4:
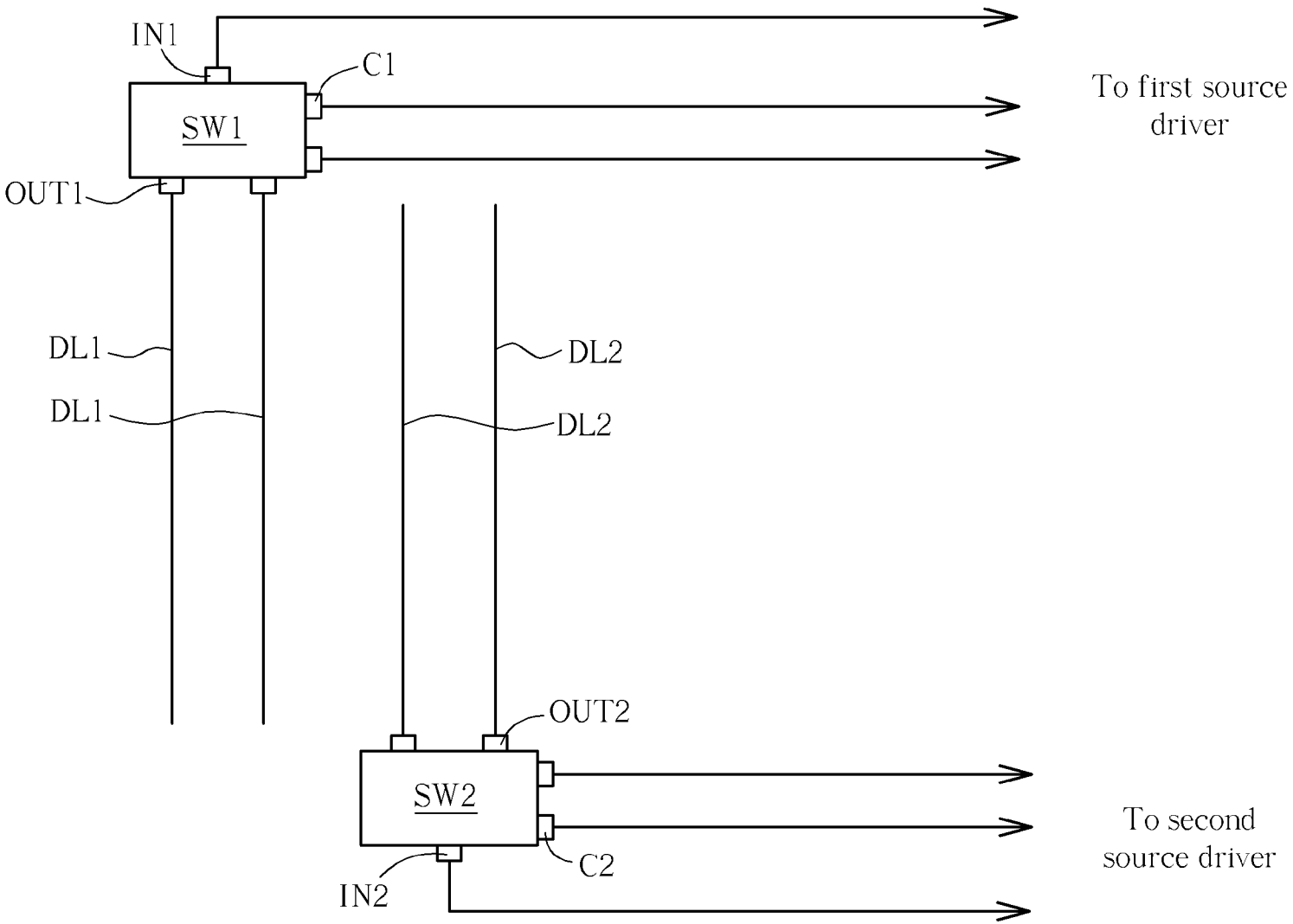
FIG. 4 is a diagram showing a first embodiment of driving switches of multiplexers of the present invention.

Please refer to FIG. 2 to FIG. 4. FIG. 2 is a diagram showing a display device of the present invention. FIG. 3 is a diagram showing a first embodiment of a display panel of the display device of FIG. 2. FIG. 4 is a diagram showing a first embodiment of driving switches of multiplexers of the present invention. The display device 200 comprises a display panel 300 for displaying images, and a backlight module 210 for providing backlight. The display panel 300 comprises a first multiplexer 310, a second multiplexer 320, a driving circuit 350, a plurality of first data lines DL1, a plurality of second data lines DL2, a plurality of scan lines SL, and a plurality pixels P. The first multiplexer 310 is arranged at a first side of the display panel 300. The first multiplexer 310 comprises a plurality of first driving switches SW1, and each first driving switch SW1 comprises a first input end IN1, a plurality of first control ends C1, and a plurality of first output ends OUT1. The first input end IN1 is electrically connected to a first source driver 352 for receiving source driving signals generated by the first source driver 352. The first control ends C1 are electrically connected to the first source driver 352 for receiving first output control signals generated by the first source driver 352. The first driving switch SW1 selects the first output ends OUT1 to output the source driving signal according to the first output control signal. The second multiplexer 320 is arranged at a second side of the display panel 300. The second multiplexer 320 comprises a plurality of second driving switches SW2, and each second driving switch SW2 comprises a second input end IN1, a plurality of second control ends C2, and a plurality of second output ends OUT2. The second input end IN2 is electrically connected to a second source driver 354 for receiving source driving signals generated by the second source driver 354. The second control ends C2 are electrically connected to the second source driver 352 for receiving second output control signals generated by the second source driver 354. The second driving switch SW1 selects the second output ends OUT2 to output the source driving signal according to the second output control signal. The first data line DL1 is electrically connected to the first output end OUT1 of the first driving switch SW1 for transmitting the source driving signal outputted from the first driving switch SW1 to the pixels P. The second data line DL2 is electrically connected to the second output end OUT2 of the second driving switch SW2 for transmitting the source driving signal outputted from the second driving switch SW2 to the pixels P. The pixels P are electrically connected to the first data lines DL1, the second data lines DL2 and the scan lines SL. When a row of pixels P are turned on by a scan driver 356 of the driving circuit 350 via the scan line SL, the turned on pixels P display images according to the source driving signals.

As shown in FIG. 3, two first data lines DL1 electrically connected to the first driving switch SW1 are arranged at a side of two second data lines DL2 electrically connected to the second driving switch SW2, and the first data lines DL1 and the second data lines DL2 are interlacedly arranged. In other words, the second driving switches SW2 arranged at a lower side of the display panel 100 correspond to the first driving switches SW1 arranged at an upper side of the display panel 100, wherein the space arrangement is that one of the second driving switches SW2 is arranged at a position corresponding to the middle of two adjacent first driving switches SW1. According to the above arrangement, horizontal spaces between the first driving switches SW1 or the second driving switches SW2 are larger (nearly double of the prior art), such that more horizontal space can be utilized for arranging the driving switches SW1, SW2, so as to further reduce required widths of the upper edge and lower edge of the display panel 300. In addition, length of a signal line L1 electrically connected between the first multiplexer 310 and the first source driver 352 is closer to length of a signal line L2 electrically connected between the second multiplexer 320 and the second source driver 354, such that loading of the pixels P controlled by the first multiplexer 310 is closer to loading of the pixels P controlled by the second multiplexer 320. Therefore, the problem of inconsistence between images displayed at the left side and right side of the display panel can be solved.

Figure 5:
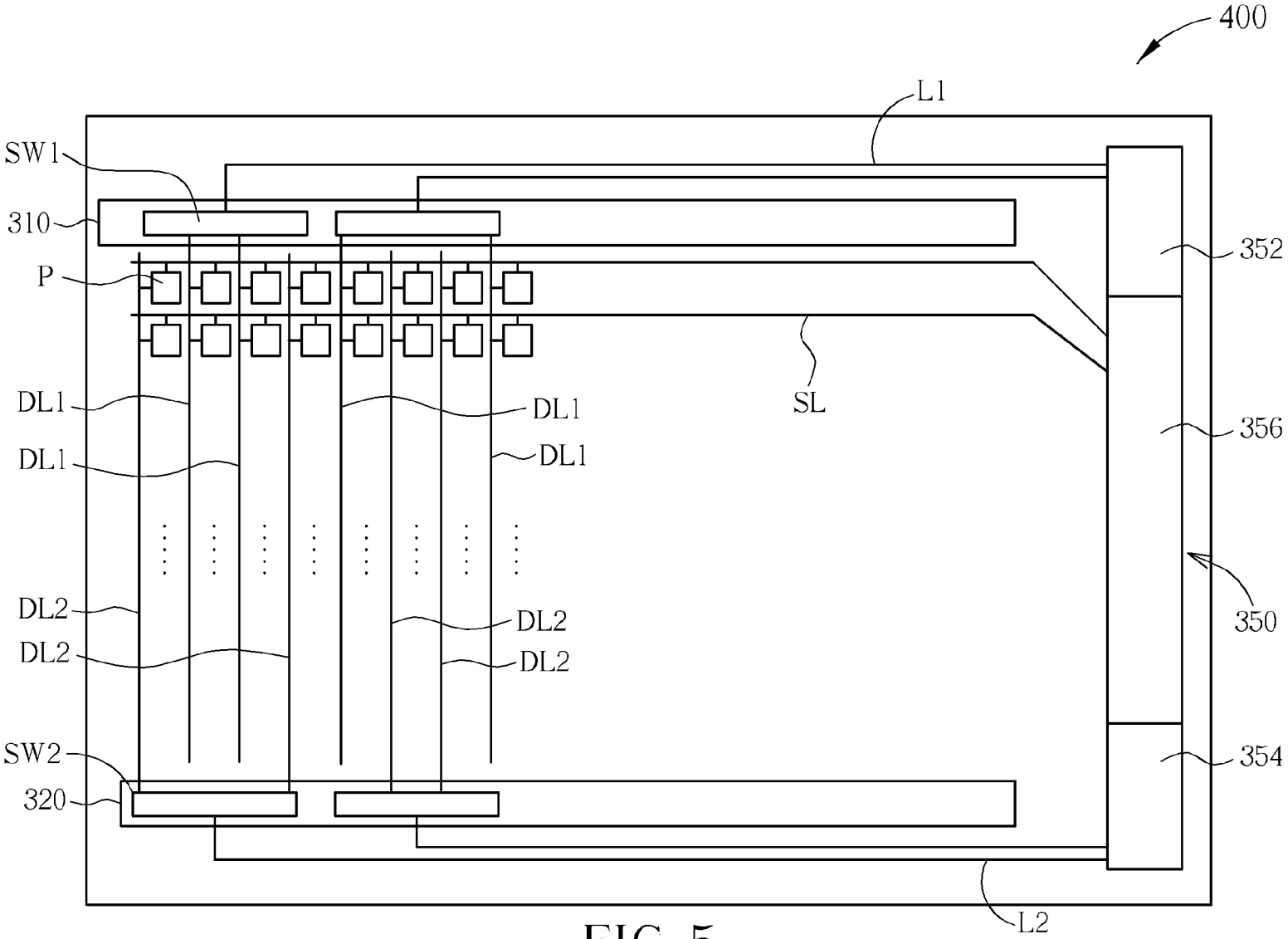
FIG. 5 is a diagram showing a second embodiment of the display panel of the present invention.

Please refer to FIG. 5. FIG. 5 is a diagram showing a second embodiment of the display panel of the present invention. As shown in FIG. 5, two first data lines DL1 electrically connected to the first driving switch SW1 are arranged between two second data lines DL2 electrically connected to the second driving switch SW2, or two second data lines DL2 electrically connected to the second driving switch SW2 are arranged between two first data lines DL1 electrically connected to the first driving switch SW1.

Figure 6:
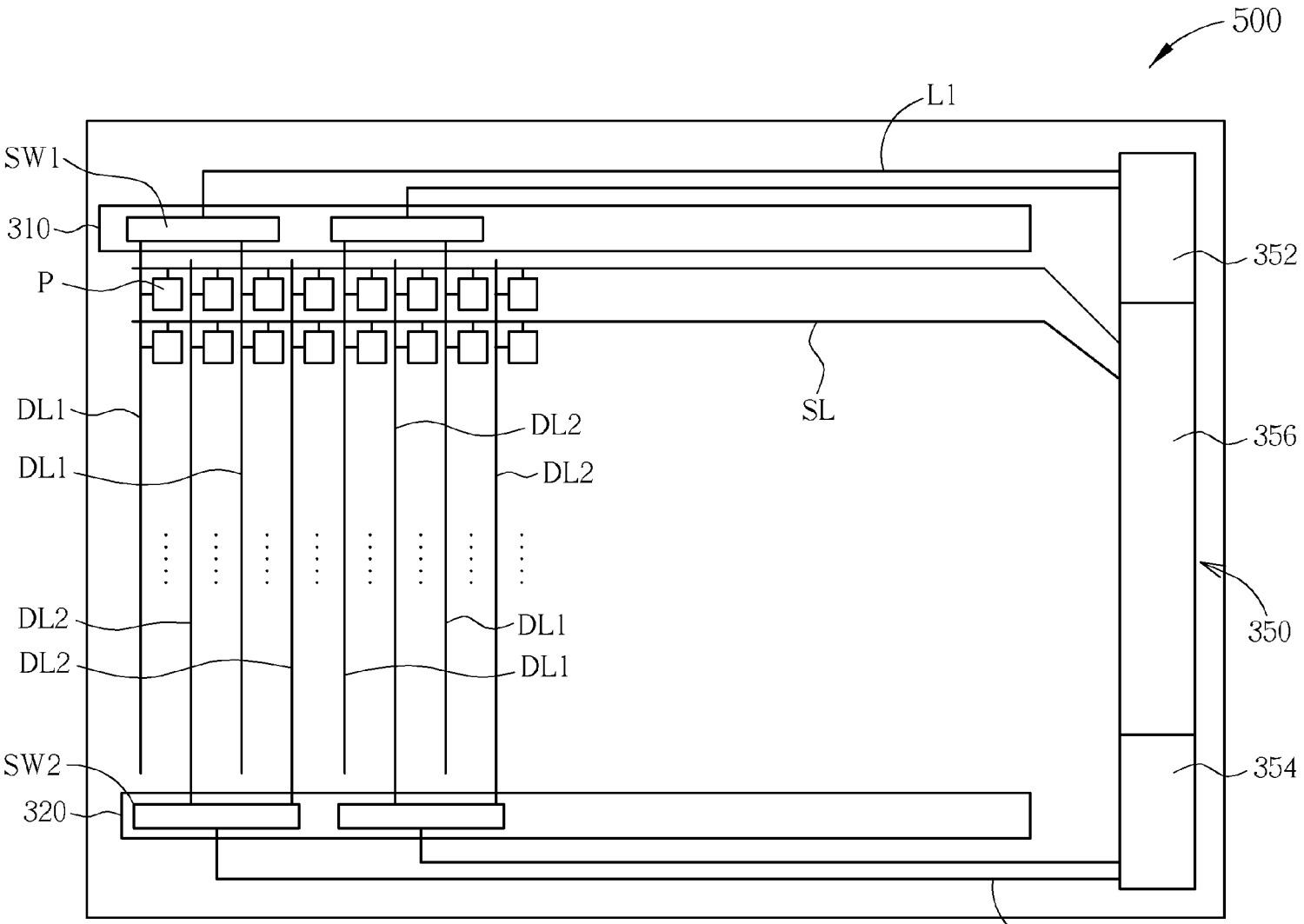
FIG. 6 is a diagram showing a third embodiment of the display panel of the present invention.
Figure 7:
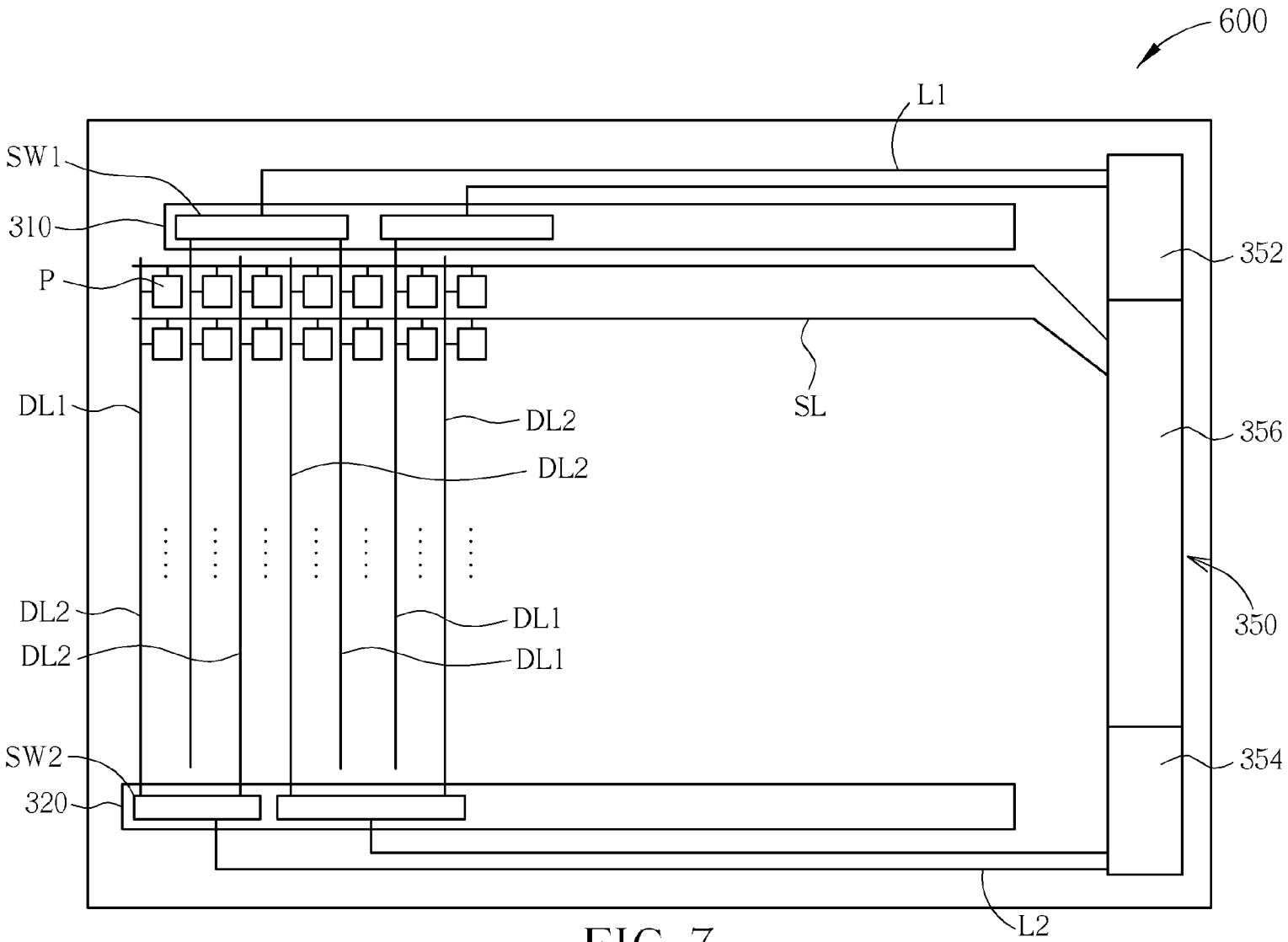
FIG. 7 is a diagram showing a fourth embodiment of the display panel of the present invention.

Please refer to FIG. 6 and FIG. 7. FIG. 6 is a diagram showing a third embodiment of the display panel of the present invention. FIG. 7 is a diagram showing a fourth embodiment of the display panel of the present invention. The first data lines DL1 electrically connected to the first driving switch SW1 and the second data lines DL2 electrically connected to the second driving switch SW2 can be interlacedly arranged as shown in FIG. 6 and FIG. 7.

Figure 8:
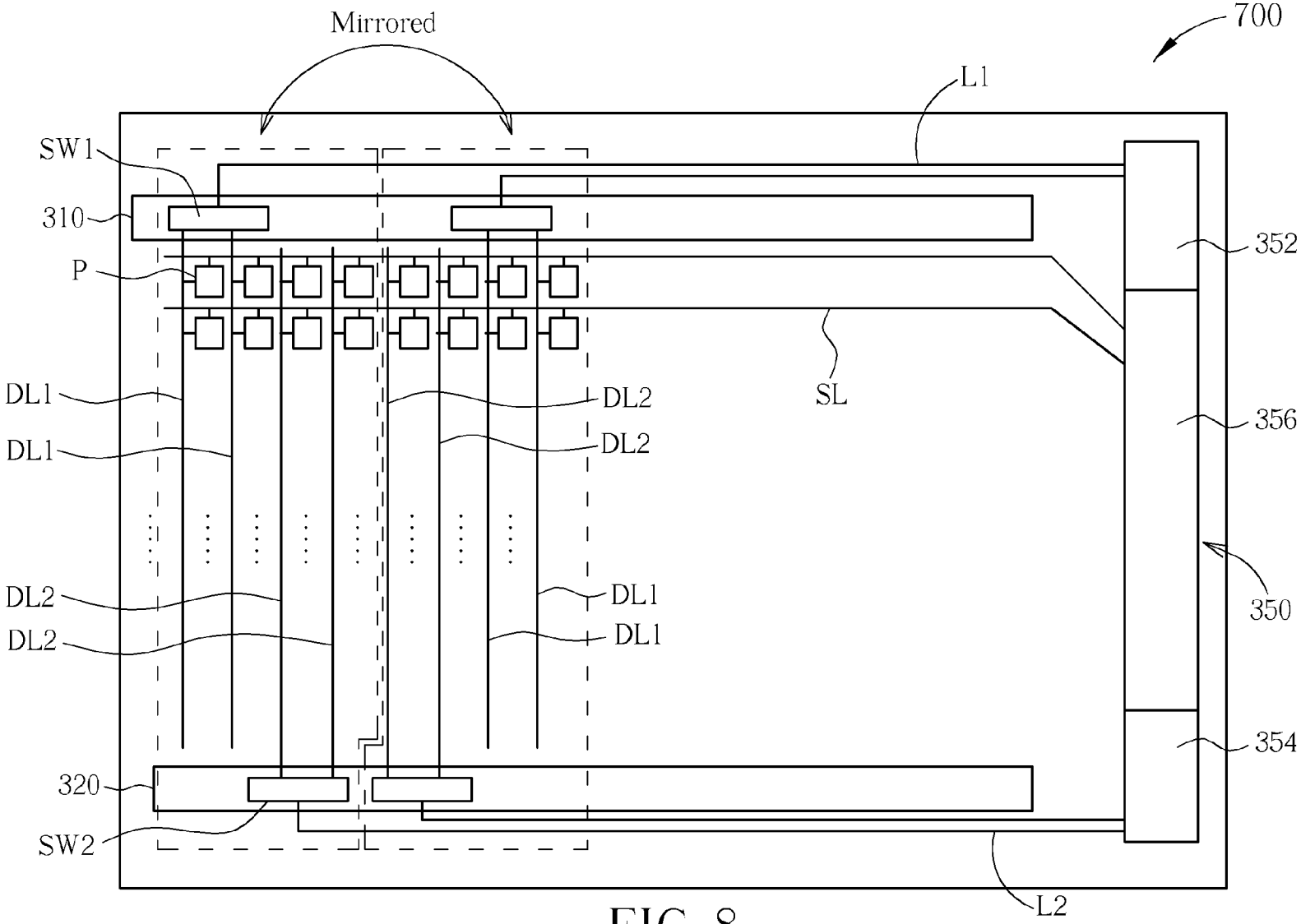
FIG. 8 is a diagram showing a fifth embodiment of the display panel of the present invention.
Figure 9:
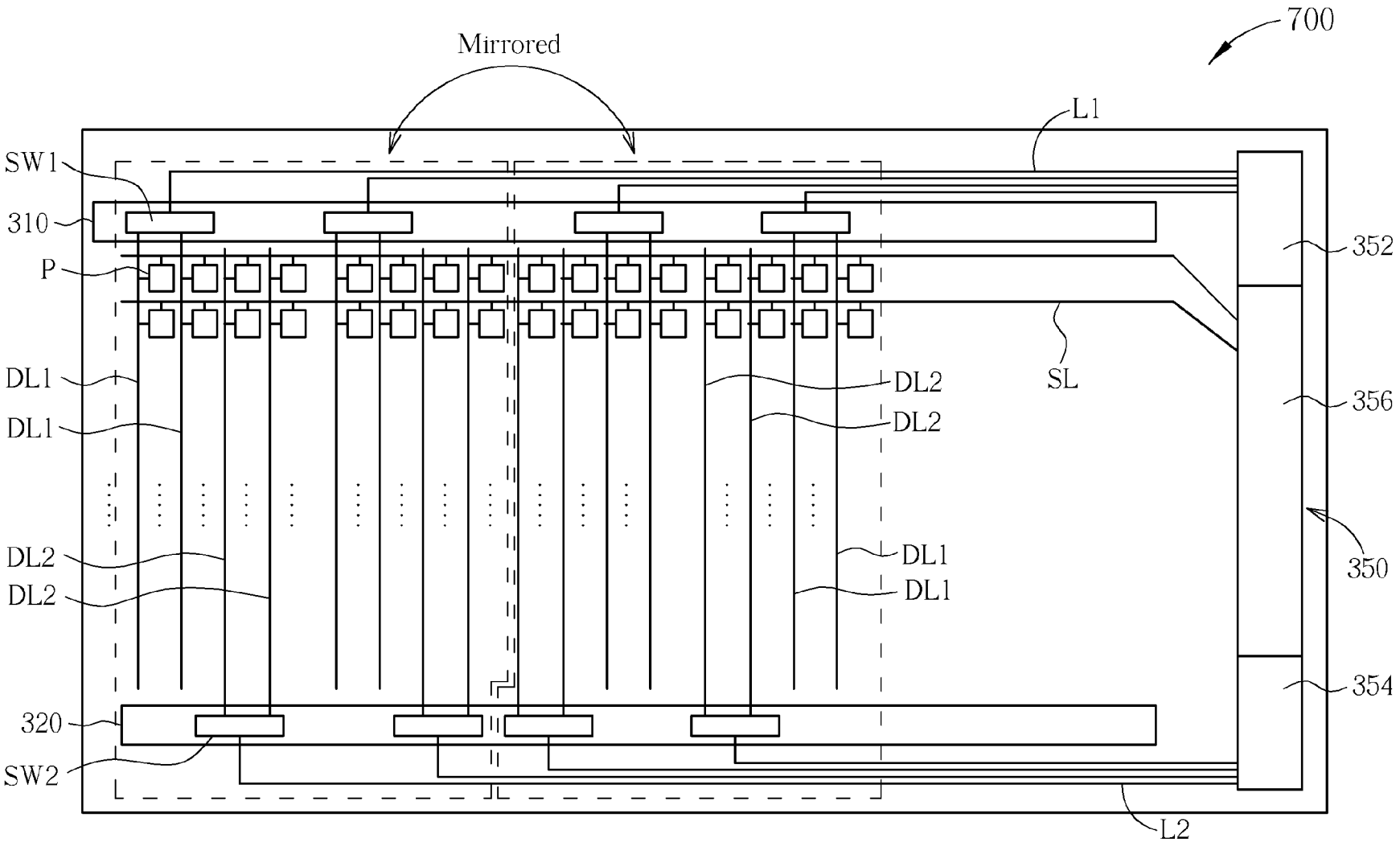
FIG. 9 is a diagram showing a sixth embodiment of the display panel of the present invention.

Moreover, there can be more variations provided by mirroring the above arrangements of the first data lines DL1 and the second data lines DL2. For example, please refer to FIG. 8 and FIG. 9. FIG. 8 is a diagram showing a fifth embodiment of the display panel of the present invention. FIG. 9 is a diagram showing a sixth embodiment of the display panel of the present invention. The arrangement of the first data lines DL1 and the second data lines DL2 in FIG. 8 is mirroring arrangement according to the arrangement of the first data lines DL1 and the second data lines DL2 in FIG. 3. In addition, the arrangement of the first data lines DL1 and the second data lines DL2 can be mirrored as shown in FIG. 9. The mirroring arrangement of the first data lines DL1 and the second data lines DL2 can further reduce mura effect caused by difference of loading. The arrangement of the first data lines DL1 and the second data lines DL2 of the present invention is not limited by the above embodiments. In other embodiments of the present invention, the first data lines DL1 and the second data lines DL2 can be arranged in other forms.

Figure 10:
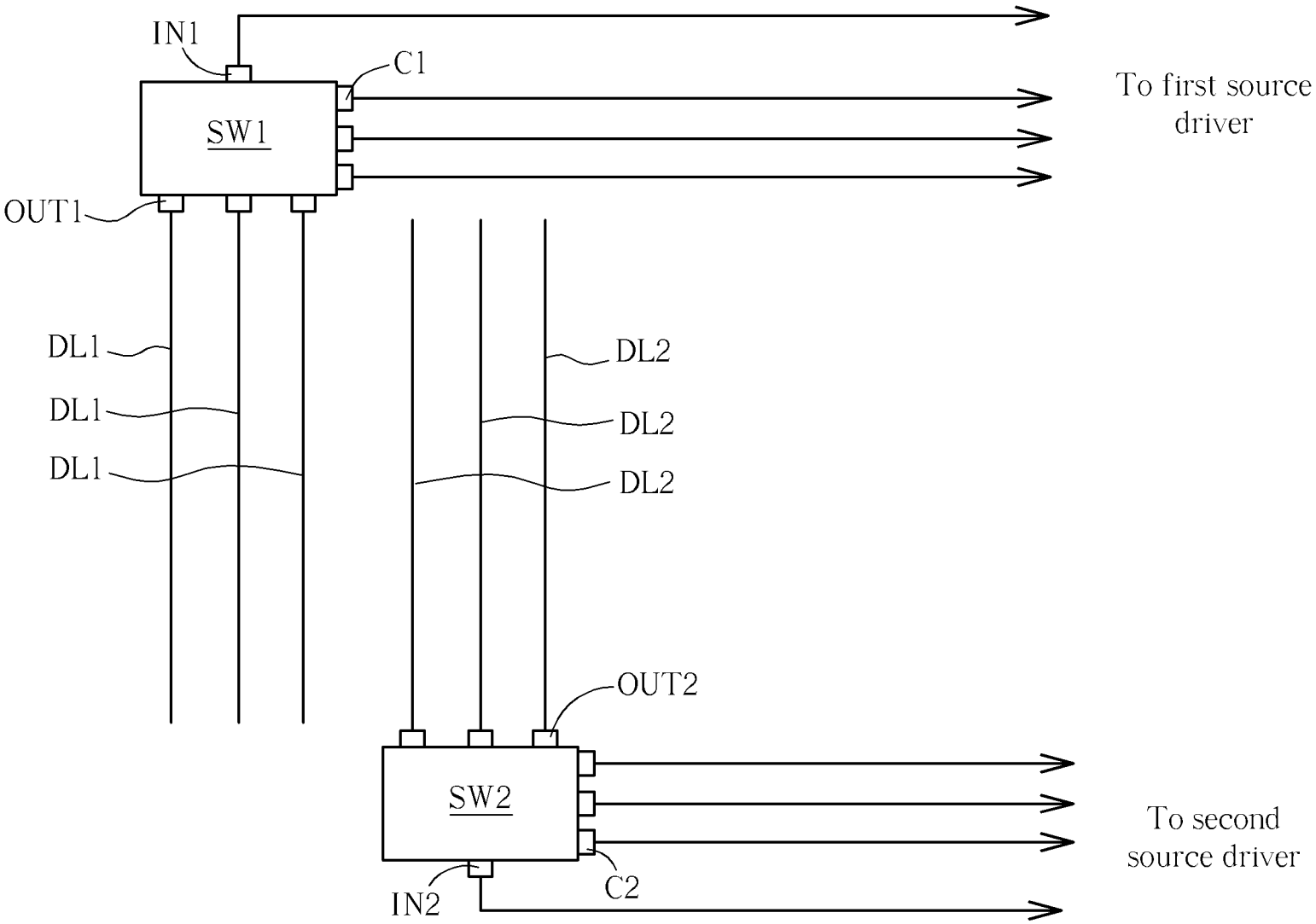
FIG. 10 is a diagram showing a second embodiment of driving switches of multiplexers of the present invention.

In the above embodiments, each of the driving switches comprises two output ends, however, in other embodiments, such as FIG. 10, each of the first and second driving switches comprises three or more than three output ends OUT1, OUT2.

In addition, the above driving circuit 350 of the display panel is an integrated driving circuit comprising the first multiplexer 352, the second multiplexer 354 and the scan driver 356 for further saving space. However, in other embodiments, it is not necessary to integrate the source driver and the scan driver together. The source driver and the scan driver can independently exist.

In contrast to the prior art, the present invention provides the display panel and the source driving structure for reducing required widths of the upper edge and the lower edge of the display panel by arranging the first data lines and the second data lines interlacedly. Moreover, difference between the loading of the pixels controlled by the first multiplexer and the loading of the pixels controlled by the second multiplexer is reduced, so as to solve the problem of inconsistence between images displayed at the left side and right side of the display panel.

In addition, the circuit structure of the present invention comprising transistors made of indium gallium zinc oxide (IGZO) can reduce required widths of the upper edge and the lower edge of the display panel by arranging the first data lines and the second data lines interlacedly, such that the problem of occupying more space by utilizing IGZO can be effectively solved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display panel, comprising:

a first multiplexer arranged at a first side of the display panel, the first multiplexer comprising a plurality of first driving switches, each first driving switch comprising:

a first input end for receiving a first source driving signal; and a plurality of first output ends for outputting the first source driving signal;

a second multiplexer arranged at a second side of the display panel, the second multiplexer comprising a plurality of second driving switches, each second driving switch comprising:

a second input end for receiving a second source driving signal; and a plurality of second output ends for outputting the second source driving signal;

a plurality of first data lines electrically connected to the plurality of first output ends for transmitting the first source driving signal;

a plurality of second data lines electrically connected to the plurality of second output ends for transmitting the second source driving signal;

a plurality of scan lines, and a plurality of pixels electrically connected to the plurality of first data lines, the plurality of second data lines and the plurality of scan lines for displaying images according to the first source driving signal and the second source driving signal;

wherein the plurality of first data lines and the plurality of second data lines are interlacedly arranged, wherein arrangement of the first data lines and the second data lines of a first display block of the display panel is mirroring arrangement according to arrangement of the first data lines and the second data lines of a second display block of the display panel adjacent to the first display block, and a sequence of the first data lines and the second data lines of the first display block along a first direction is opposite to a sequence of the first data lines and the second data lines of the second display block along the first direction.

2. The display panel of claim 1, wherein the first driving switch comprises two first output ends, and the second driving switch comprises two second output ends.

3. The display panel of claim 1, wherein the first driving switch comprises more than three first output ends, and the second driving switch comprises more than three second output ends.

4. The display panel of claim 1, wherein the first driving switch further comprises a plurality of first control ends for receiving a plurality of first output control signals, the first driving switch is for selecting the plurality of first output ends to output the first source driving signal according to the plurality of first output control signals; and the second driving switch further comprises a plurality of second control ends for receiving a plurality of second output control signals, the second driving switch is for selecting the plurality of second output ends to output the second source driving signal according to the plurality of second output control signals.

5. The display panel of claim 1 further comprising a driving circuit electrically connected to the first multiplexer and the second multiplexer for generating the first source driving signal and the second source driving signal.

6. The display panel of claim 5, wherein the driving circuit comprising:

a first source driver electrically connected to the first multiplexer for generating the first source driving signal;

a second source driver electrically connected to the second multiplexer for generating the second source driving signal; and a scan driver electrically connected to the plurality of pixels via the plurality of scan lines for controlling on and off states of the pixels.

7. The display panel of claim 1, wherein the plurality of first driving switches and the plurality of second driving switches respectively comprise transistors made of indium gallium zinc oxide (IGZO).

8. A display device, comprising:

a display panel of claim 1;

a first source driver electrically connected to the first multiplexer for generating the first source driving signal;

a second source driver electrically connected to the second multiplexer for generating the second source driving signal;

a scan driver electrically connected to the plurality of pixels via the plurality of scan lines for controlling on and off states of the pixels; and a backlight module arranged at a side of the display panel for providing backlight.

9. The display device of claim 8, wherein the first driving switch comprises two first output ends, and the second driving switch comprises two second output ends.

10. The display device of claim 8, wherein the first driving switch comprises more than three first output ends, and the second driving switch comprises more than three second output ends.

11. The display device of claim 8, wherein the first driving switch further comprises a plurality of first control ends for receiving a plurality of first output control signals, the first driving switch is for selecting the plurality of first output ends to output the first source driving signal according to the plurality of first output control signals; and the second driving switch further comprises a plurality of second control ends for receiving a plurality of second output control signals, the second driving switch is for selecting the plurality of second output ends to output the second source driving signal according to the plurality of second output control signals.

12. The display device of claim 8, wherein the plurality of first driving switches and the plurality of second driving switches respectively comprise transistors made of indium gallium zinc oxide (IGZO).

* * * * *